US008220374B2

(12) United States Patent
Wang

(10) Patent No.: US 8,220,374 B2
(45) Date of Patent: Jul. 17, 2012

(54) RETAINING DEVICE FOR WOOD SAWING MACHINE

(76) Inventor: Tian Wang Wang, Taiping (TW)

( * ) Notice: Subject to any disclaimer, the term of this patent is extended or adjusted under 35 U.S.C. 154(b) by 223 days.

(21) Appl. No.: 12/796,880

(22) Filed: Jun. 9, 2010

(65) Prior Publication Data

US 2011/0303064 A1 Dec. 15, 2011

(51) Int. Cl.
*B27B 27/10* (2006.01)

(52) U.S. Cl. ..... 83/435.15; 83/446; 83/453; 83/468.3

(58) Field of Classification Search ..... 83/438–442, 83/444–449, 451–454, 456, 457, 460, 467.1, 83/464, 468–468.7, 522.11, 522.15–522.18, 83/437.1–437.2, 477.2, 435.11, 435.12, 435.14, 83/435.15; 144/253.1, 286.1
See application file for complete search history.

(56) References Cited

U.S. PATENT DOCUMENTS

| | | | | |
|---|---|---|---|---|
| 4,481,846 | A * | 11/1984 | Goodell | 83/438 |
| 5,038,486 | A * | 8/1991 | Ducate, Sr. | 33/430 |
| 5,040,444 | A * | 8/1991 | Shiotani et al. | 83/473 |
| 6,688,202 | B2 * | 2/2004 | Parks et al. | 83/435.27 |
| 7,798,187 | B1 * | 9/2010 | Duginske | 144/253.1 |
| 2002/0104417 | A1 * | 8/2002 | Chen | 83/435.14 |
| 2006/0201298 | A1 * | 9/2006 | Smith | 83/468 |
| 2010/0269657 | A1 * | 10/2010 | Koegel et al. | 83/444 |

* cited by examiner

*Primary Examiner* — Phong Nguyen

(57) ABSTRACT

A retaining device for a wood sawing machine contains an index table fixed on a cutting deck of the wood sawing machine to displace straightly and reciprocately along the cutting deck; a guiding plate fixed on the cutting deck, connected with the index table, and including a slot disposed thereon; a vertically moving set including at least one sliding block, at least one screw rod, a longitudinally displacing holder, at least one first adjusting nuts, and at least one first second adjusting nuts; wherein the sliding block is slidably connected with the slot of the guiding plate and displaces along the slot reciprocately, the screw rod is coupled on the sliding block respectively; a retaining and pressing assembly including a handle, two arms, two connecting posts, two stems, and a pressing panel.

5 Claims, 14 Drawing Sheets

RETAINING DEVICE FOR WOOD SAWING MACHINE

BACKGROUND OF THE INVENTION

1. Field of the Invention

The present invention relates to a wood sawing machine, and more particularly to a retaining device for a wood sawing machine.

2. Description of the Prior Art

A conventional wood sawing machine is used to cut a wood workpiece and abuts the wood workpiece against the index table at a desired cutting angle. Besides, the index table allows to be adjusted toward the angle before cutting the wood workpiece.

However, a user has to force the wood workpiece to abut against the index table, and such a force is not equal to have a poor precision, and the wood workpiece flies out of the wood sawing machine to injure the user.

Moreover, some wood sawing machines press and retain the wood workpiece by using a mechanism having springs and cams, but such a mechanism can not force evenly to injure the user.

The present invention has arisen to mitigate and/or obviate the afore-described disadvantages.

SUMMARY OF THE INVENTION

The primary object of the present invention is to provide a retaining device for a wood sawing machine that forces the workpiece evenly.

Another object of the present invention is to provide a retaining device for a wood sawing machine that retains the workpiece stably to prevent the user from getting injury.

A retaining device for a wood sawing machine in accordance with a preferred embodiment of the present invention comprises:

an index table fixed on a cutting deck of the wood sawing machine to displace straightly and reciprocately along the cutting deck;

a guiding plate fixed on the cutting deck, connected with the index table, and including a slot disposed thereon;

a vertically moving set including at least one sliding block, at least one screw rod, a longitudinally displacing holder, at least one first adjusting nuts, and at least one first second adjusting nuts; wherein the sliding block is slidably connected with the slot of the guiding plate and displaces along the slot reciprocately, the screw rod is coupled on the sliding block respectively, and the longitudinally displacing holder includes holes arranged on top and bottom ends thereof individually to insert the screw rods, the second adjusting nuts are screwed with the screw rods and located beneath the longitudinally displacing holder, the first adjusting nuts are screwed on the screw rods and located above the longitudinally displacing holder;

a retaining and pressing assembly including a handle, two arms, two connecting posts, two stems, and a pressing panel, wherein one ends of the arms are locked on one ends of the handle, and each arm includes an orifice, two ends of the connecting post are axially connected on the two first bores of the longitudinally displacing holder and the orifice of the arm, one end of the stem is coupled with the pressing panel, and another end of the stem is axially connected with another end of the arm, between the two ends of the stem are defined a first aperture and a second aperture to insert the stems alternatively, and the stems are axially connected on second bores of the longitudinally displacing holder from the coupling shank.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
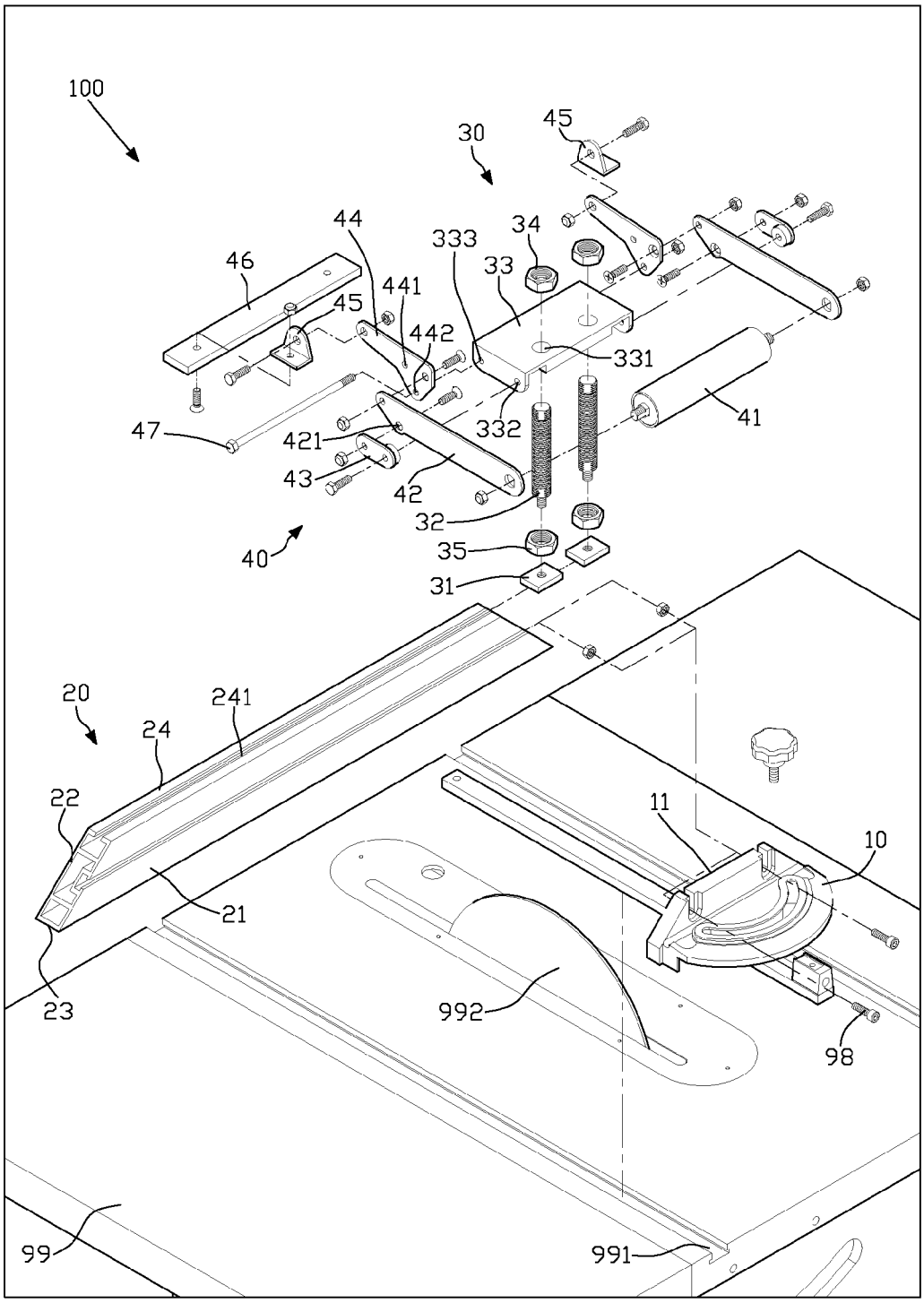
FIG. 1 is a perspective view showing the exploded components of a retaining device for a wood sawing machine according to a preferred embodiment of the present invention.
Figure 2:
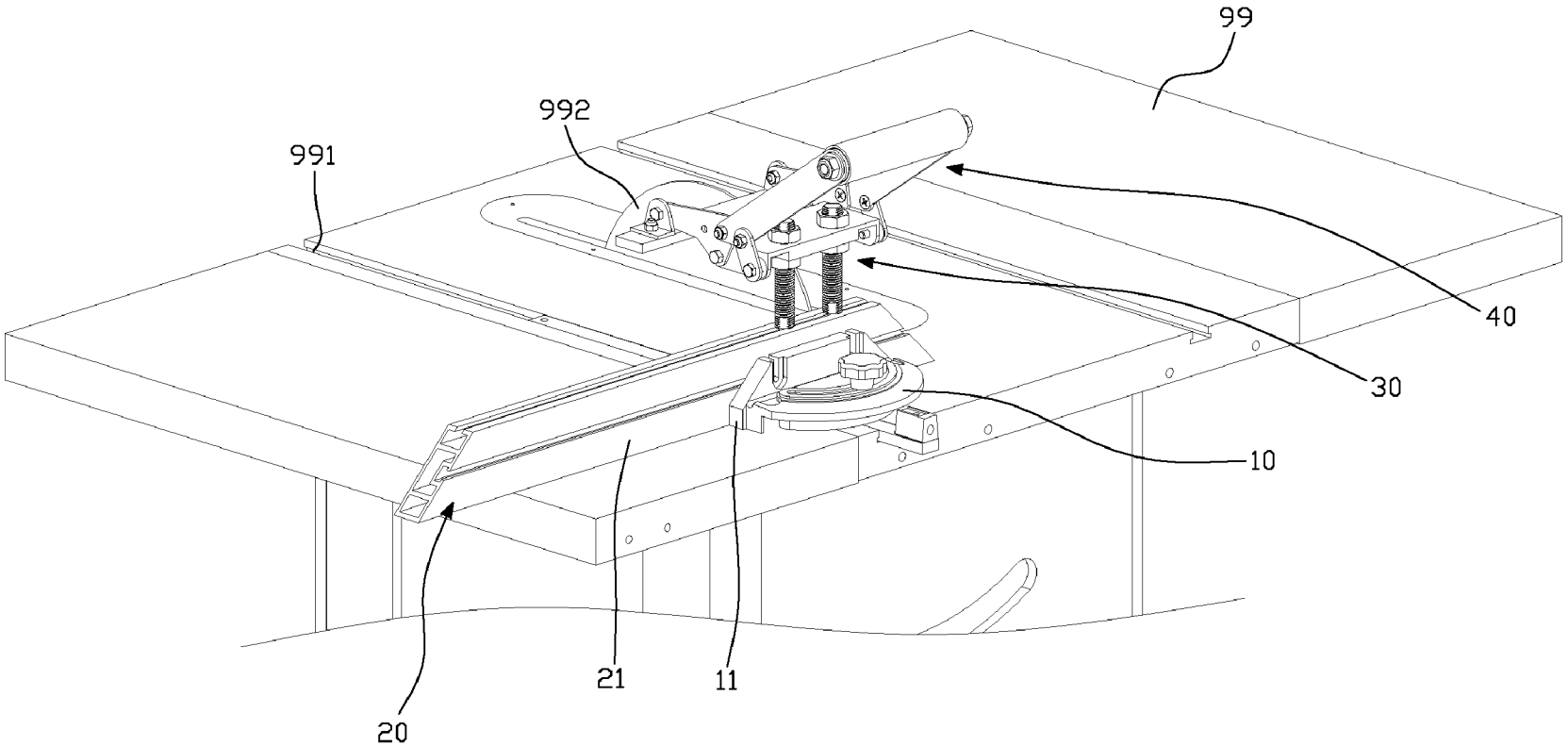
FIG. 2 is a perspective view showing the assembly of the retaining device for the wood sawing machine according to the preferred embodiment of the present invention.

Referring to FIGS. 1-14, a retaining device 100 for a wood sawing machine in accordance with a preferred embodiment of the present invention comprises an index table 10, a guiding plate 20, a vertically moving set 30, and a retaining and pressing assembly 40, wherein the index table 10 as shown in FIGS. 1 and 2 includes an abutting surface 11 and is fixed on a cutting deck 99 of the wood sawing machine so as to displace straightly and reciprocately along a rail 991 of the cutting deck 99, and the index table 10 allows to rotate at a fixed position so that an angle between the abutting surface 11 and a saw blade 992 is adjusted.

Referring to FIGS. 1 and 2, the guiding plate 20 includes a first side plane 21, a second side plane 22 opposite to the first side plane 21, a bottom plane 23 connected with the first and the second side planes 21, 22, and a top plane 24 opposite to the bottom plane 23; the first side plane 21 is biased against the abutting surface 11 of the index table 10 by using a plurality of locking elements 98 so that the bottom plane 23 contacts with the cutting deck 99, and a workpiece is in contact with the second side plane 22, the top plane 24 includes a slot 241 disposed thereon.

With reference to FIGS. 1 and 2, the vertically moving set 30 includes two sliding blocks 31, two screw rods 32, a longitudinally displacing holder 33, two first adjusting nuts 34, and two second adjusting nuts 35; the sliding block 31 is slidably connected with the slot 241 of the guiding plate 20 and displaces along the slot 241 reciprocately, one ends of the screw rods 32 are coupled on the sliding blocks 31 respectively, and the longitudinally displacing holder 33 includes holes 331 arranged on top and bottom ends thereof individually to insert the screw rods 32, the longitudinally displacing holder 33 includes two first bores 332 and two second bores 333 formed on two sides thereof respectively, the second adjusting nuts 35 are screwed with the screw rods 32 and located beneath the longitudinally displacing holder 33, the first adjusting nuts 34 are screwed on the screw rods 32 and located above the longitudinally displacing holder 33 so as to limit a height of the longitudinally displacing holder 33 on the screw rods 32 from the first and the second adjusting nuts 34, 35.

As illustrated in FIGS. 1 and 2, the retaining and pressing assembly 40 includes a handle 41, two arms 42, two connecting posts 43, two stems 44, two press members 45, a pressing panel 46, and a coupling shank 47; one ends of the arms 42 are locked on one ends of the handle 41, and each arm 42 includes an orifice 421, two ends of the connecting post 43 are axially connected on the two first bores 332 of the longitudinally displacing holder 33 and the orifice 421 of the arm 42, one end of the stem 44 is coupled with the pressing panel 46 by using the press member 45, and another end of the stem 44 is axially connected with another end of the arm 42, between the two ends of the stem 44 are defined a first aperture 441 and a second aperture 442 to insert the stems 44 alternatively, and the sterns 44 are axially connected on the second bores 333 of the longitudinally displacing holder 33 from the coupling shank 47.

Figure 3:
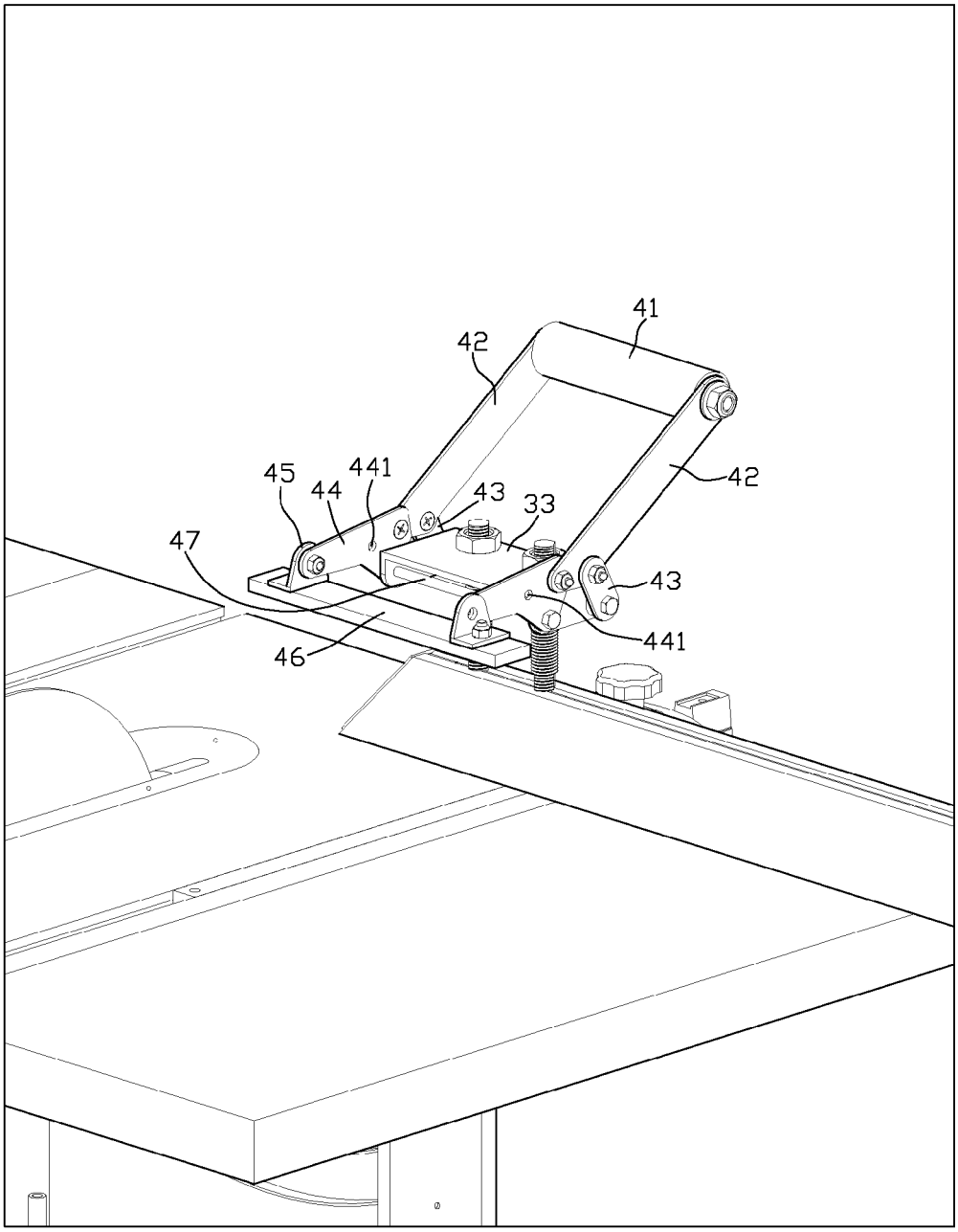
FIG. 3 is a perspective view showing a retaining and pressing assembly being located at a high position and not pressing a workpiece according to the preferred embodiment of the present invention.
Figure 4:
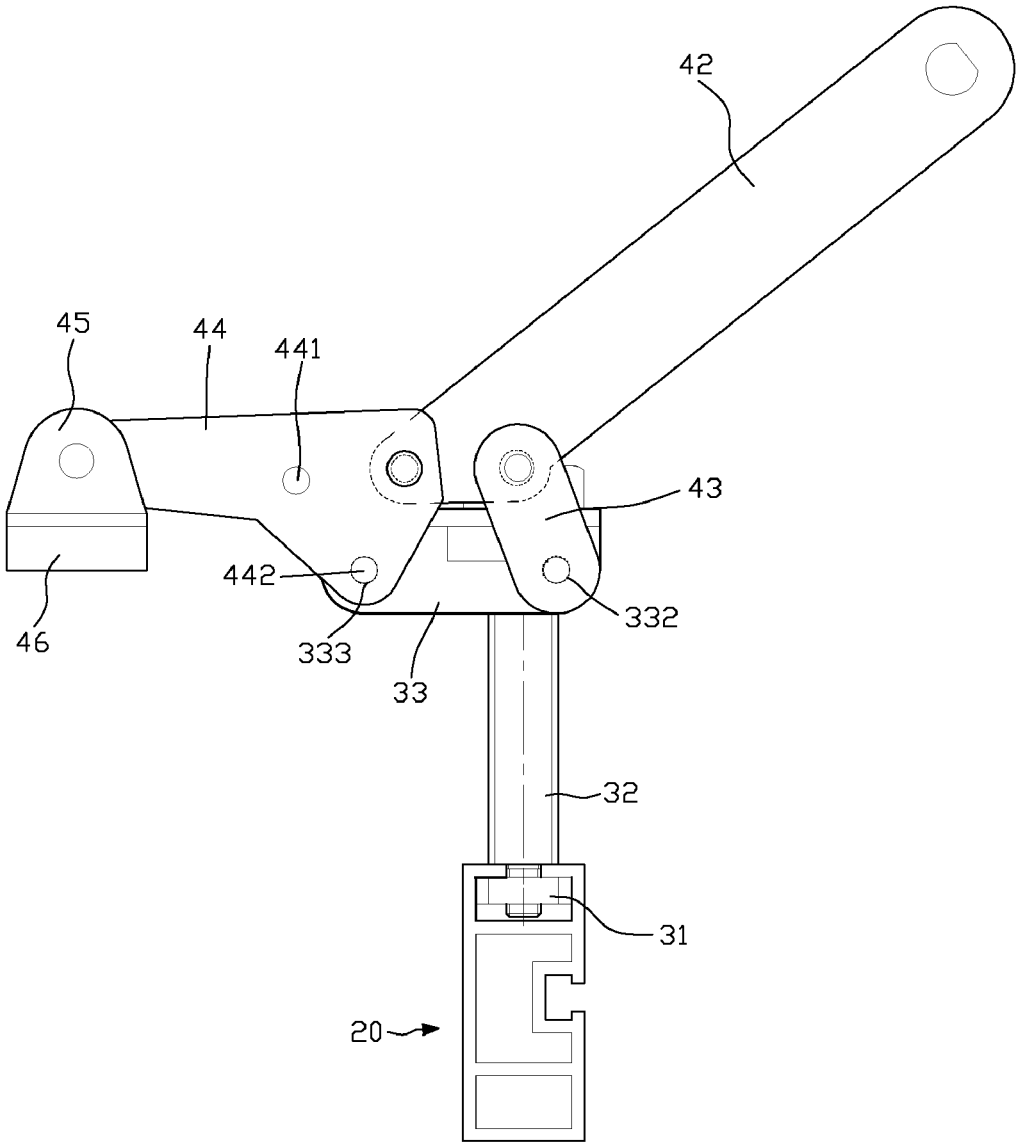
FIG. 4 is a side plan view showing the retaining and pressing assembly being located at the high position and not pressing the workpiece according to the preferred embodiment of the present invention.
Figure 5:
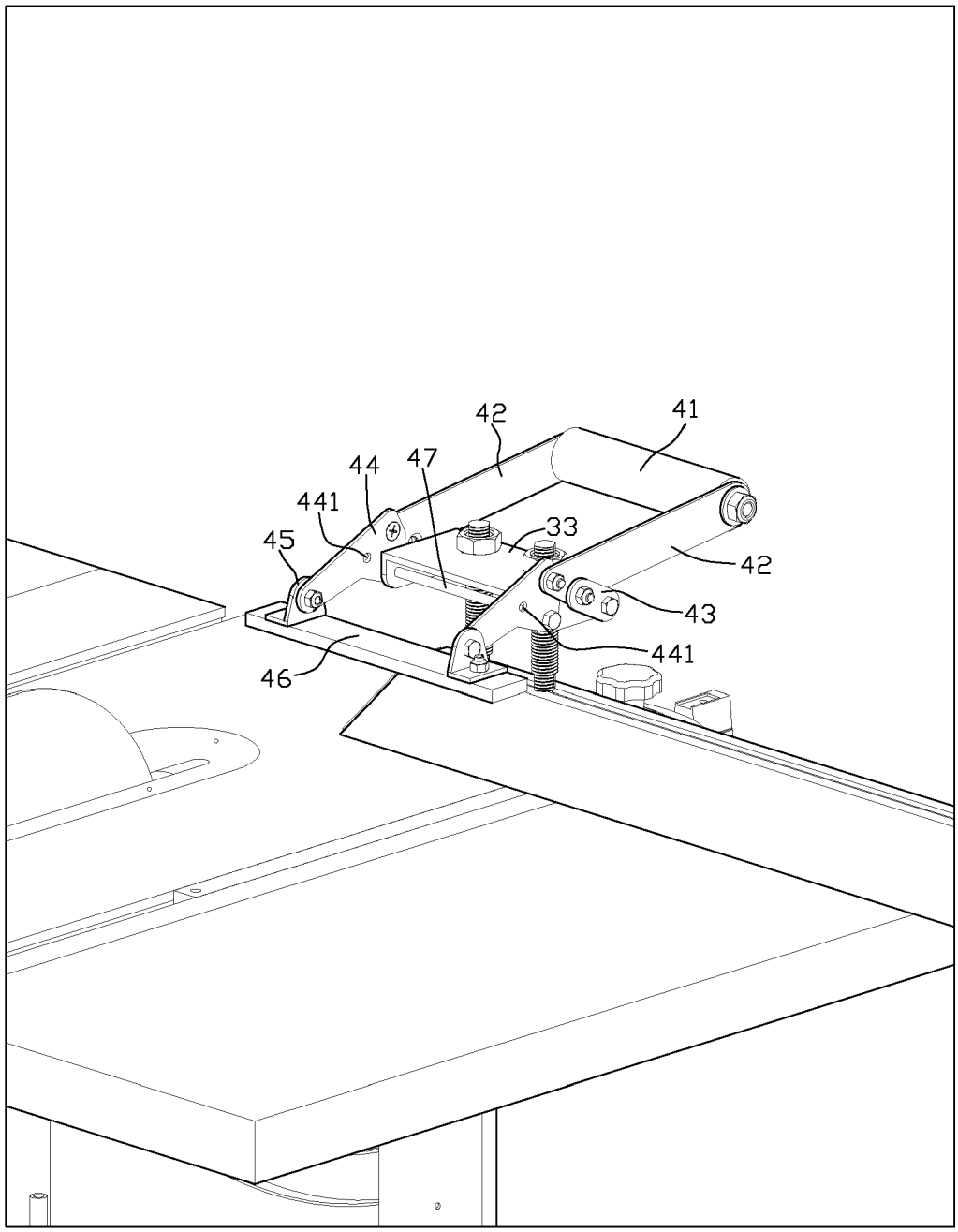
FIG. 5 is a perspective view showing the retaining and pressing assembly being located at the high position and pressing the workpiece according to the preferred embodiment of the present invention.
Figure 6:
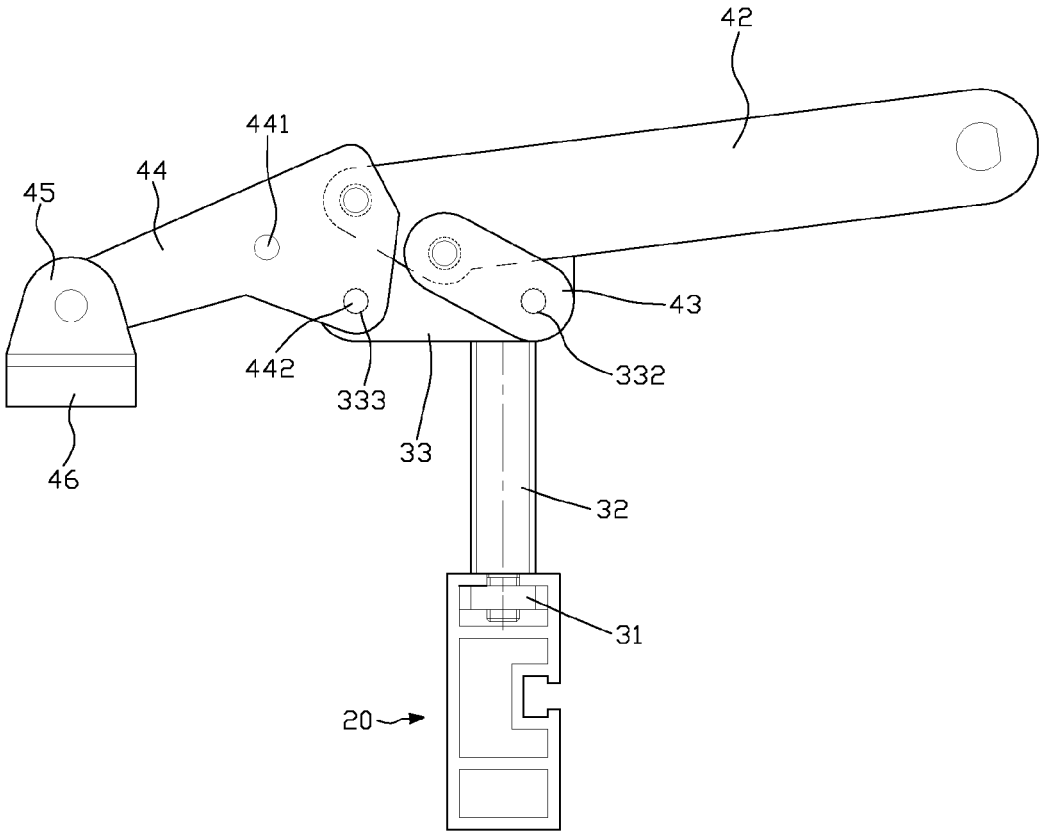
FIG. 6 is a side plan view showing the retaining and pressing assembly being located at the high position and pressing the workpiece according to the preferred embodiment of the present invention.
Figure 11:
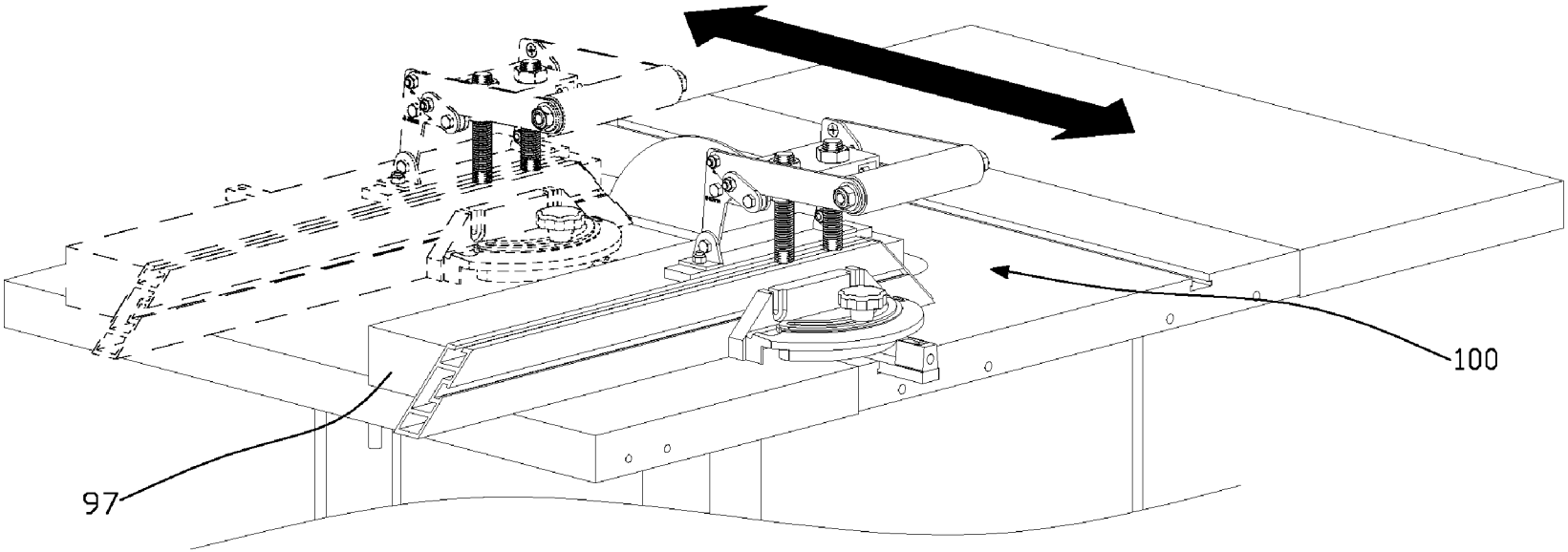
FIG. 11 is a perspective view showing the operation of the retaining device for the wood sawing machine according to the preferred embodiment of the present invention.

In operation, the first aperture 441 or the second aperture 442 of the stems 44 is connected with the second bore 333 of the longitudinally displacing holder 33, and when the workpiece is thick, the second aperture 442 of the stem 44 is axially coupled on the second bore 333 of the longitudinally displacing holder 33 by ways of the coupling shank 47 (as shown in FIGS. 3 and 4). Because the second aperture 442 is located beneath the first aperture 441, the pressing panel 46 allows to be raised toward a predetermined height equal to a distance between the first aperture 441 and the second aperture 442, and when the pressing panel 46 is located at a high position, the handle 41 is rotated downward (as illustrated in FIGS. 5 and 6) to actuate the arms 42, the connecting post 43, the stems 44, and the press member 45, and then the pressing panel 46 is actuated to press the workpiece such that the index table 10 actuates the guiding plate 20, the vertically moving set 30, the retaining and pressing assembly 40, and the workpiece 97 (as illustrated in FIG. 11) to displace along the rail 991 of the cutting deck 99, then the saw blade 992 saws the workpiece.

Thereby, the retaining device 100 forces and retains the workpiece evenly and stably to prevent the user from getting injury.

Figure 7:
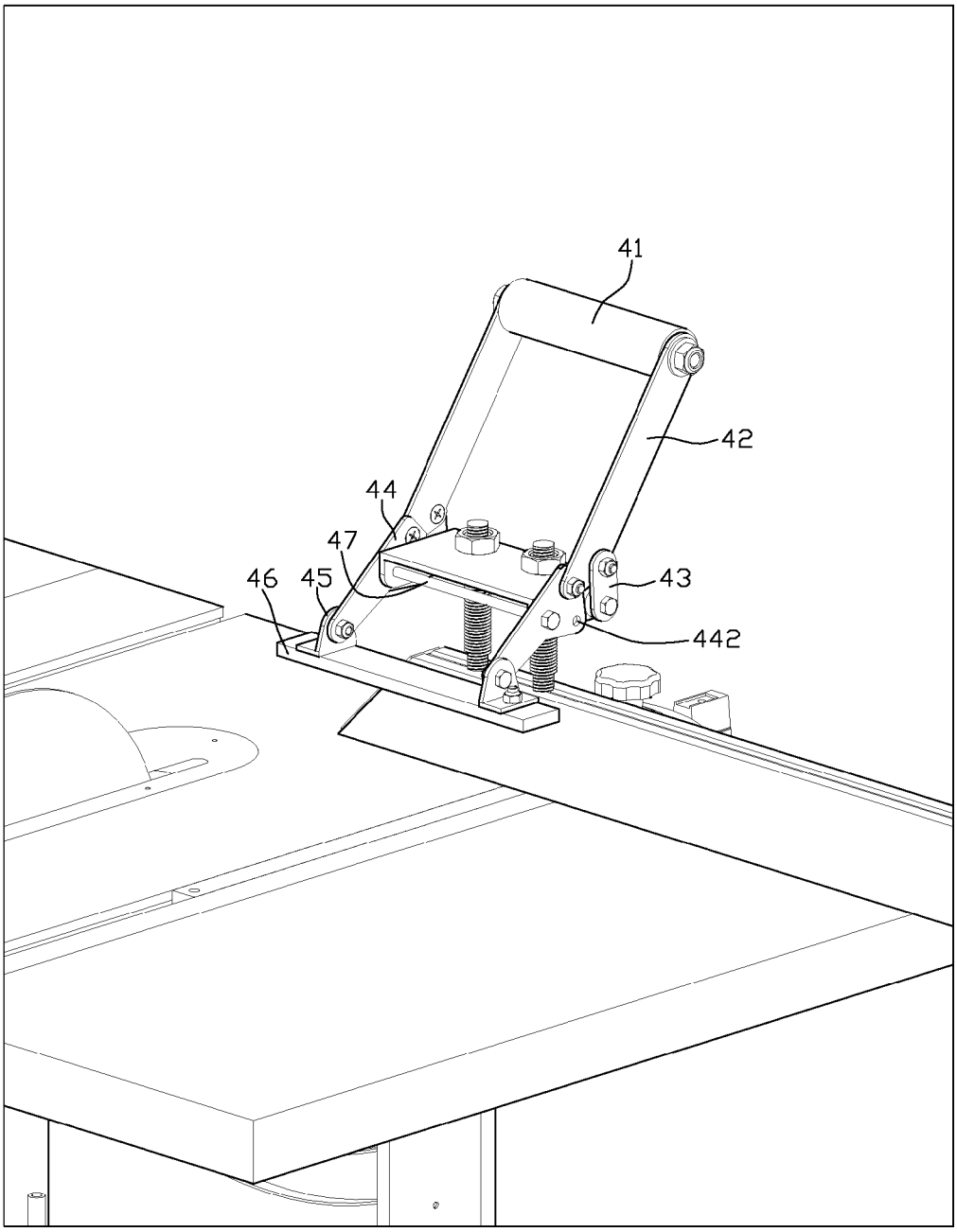
FIG. 7 is a perspective view showing the retaining and pressing assembly being located at a lower position and not pressing the workpiece according to the preferred embodiment of the present invention.
Figure 8:
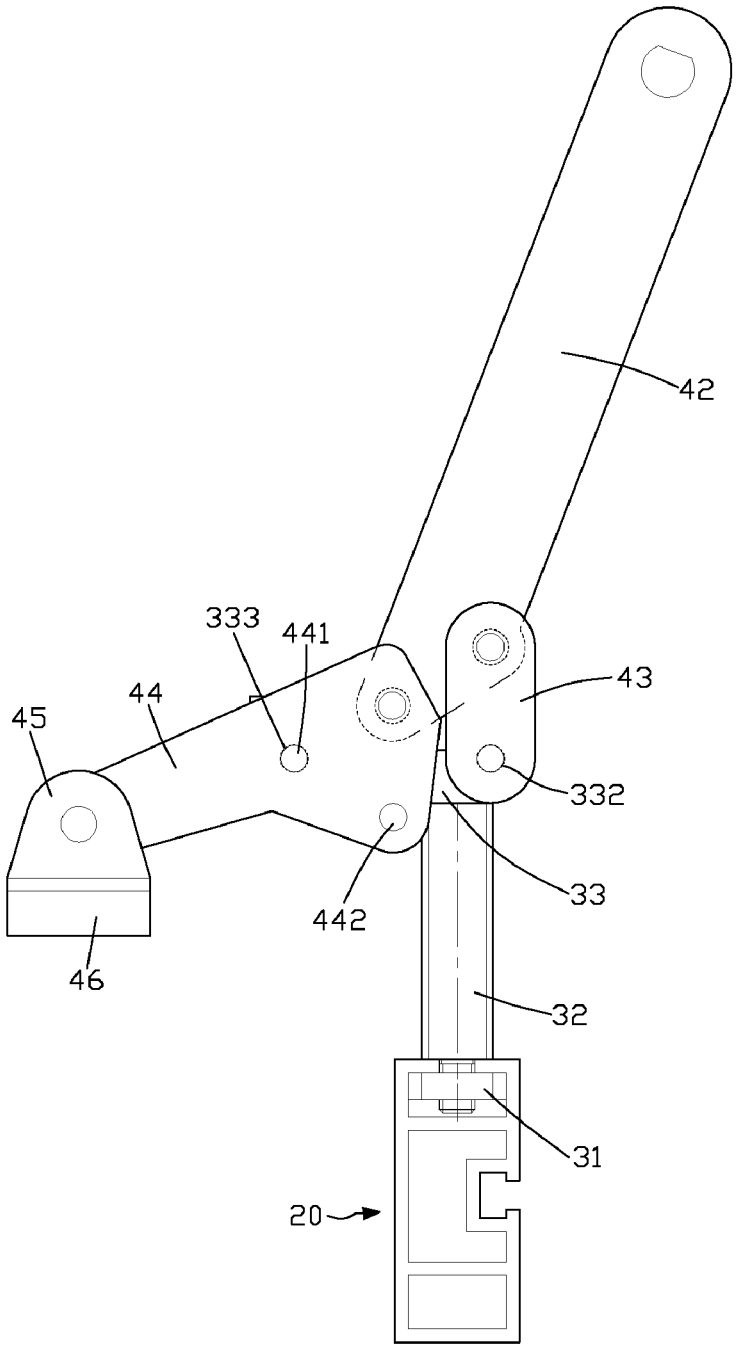
FIG. 8 is a side plan view showing the retaining and pressing assembly being located at the lower position and not pressing the workpiece according to the preferred embodiment of the present invention.
Figure 9:
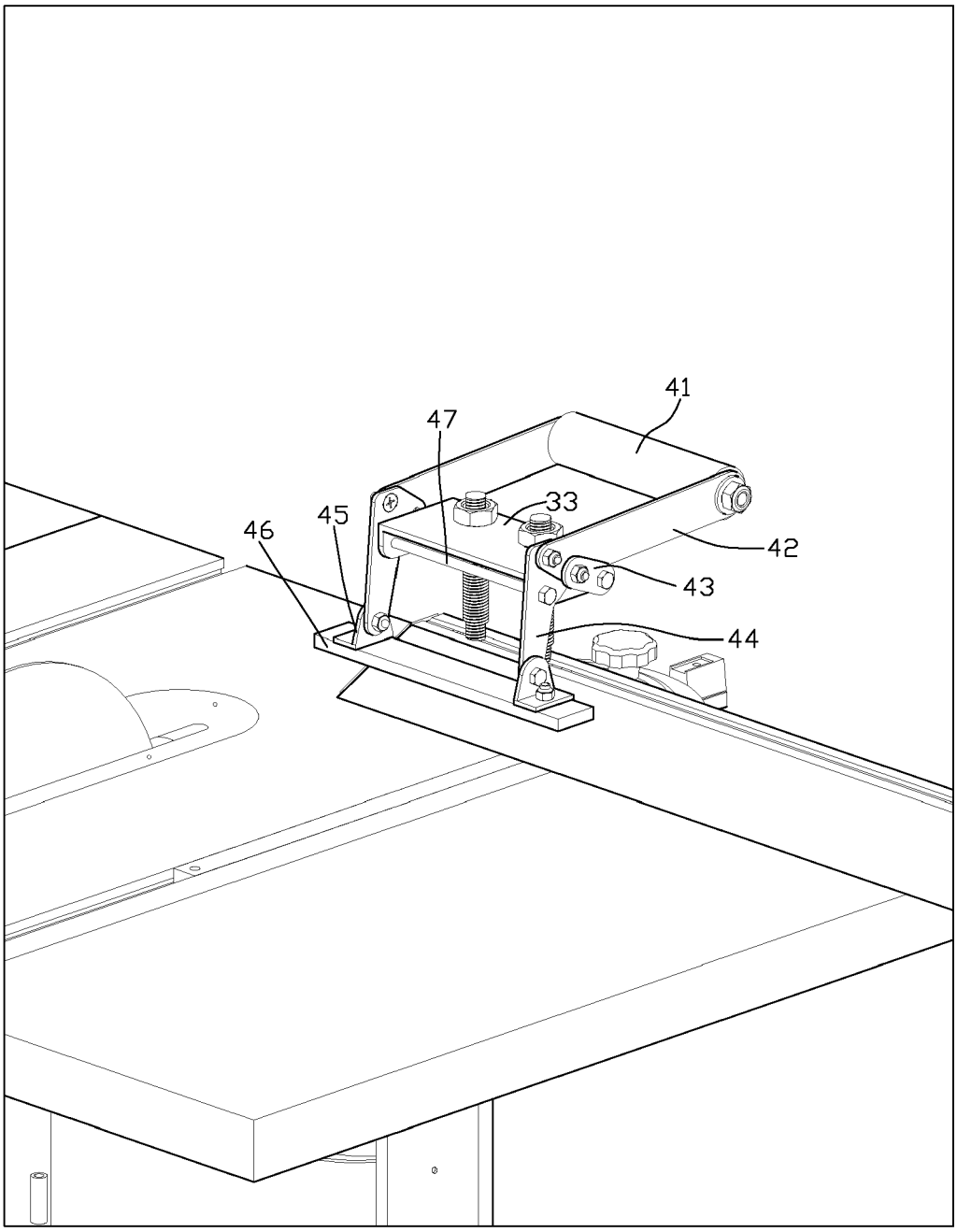
FIG. 9 is a perspective view showing the retaining and pressing assembly being located at the lower position and pressing the workpiece according to the preferred embodiment of the present invention.
Figure 10:
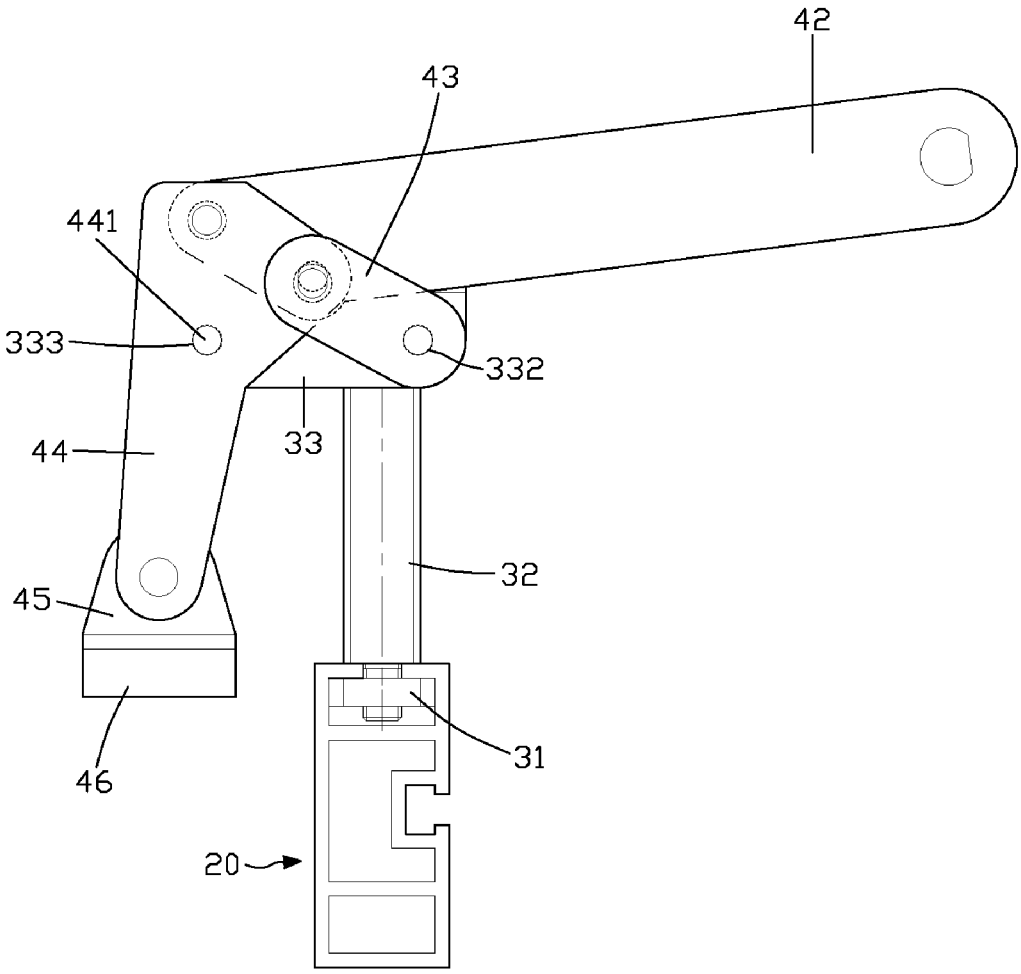
FIG. 10 is a side plan view showing the retaining and pressing assembly being located at the lower position and pressing the workpiece according to the preferred embodiment of the present invention.

Thereafter, when desiring to saw a thin workpiece, the first aperture 441 of the stem 44 axially connects with the second bore 333 of the longitudinally displacing holder 33 (as illustrated in FIGS. 7 and 8). Because the first aperture 441 is located above the second aperture 442, the pressing panel 46 is lowered toward a predetermined height. For example, when the pressing panel 46 is located at a lower position to retain the workpiece, the handle 41 is rotated downward (as shown in FIGS. 9 and 10) so that the arms 42, the connecting post 43, the stems 44, and the press member 45 are actuated to actuate the pressing panel 46 to press the workpiece, thus retaining the workpiece securely.

Figure 12:
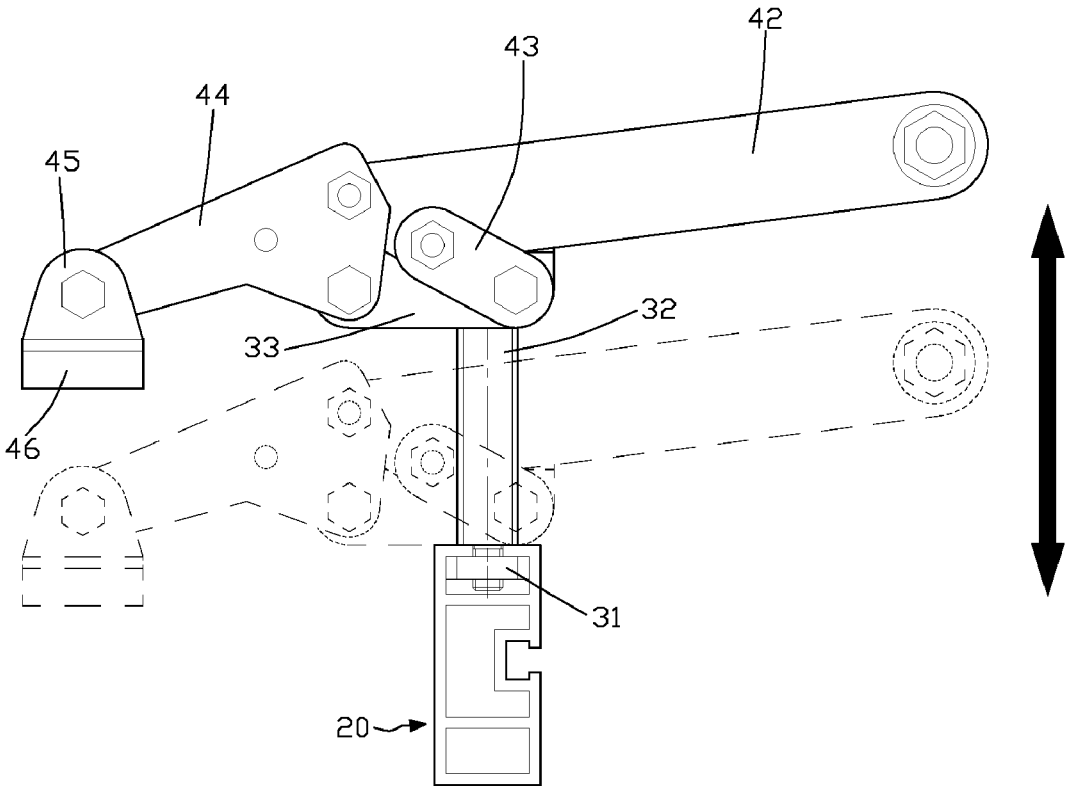
FIG. 12 is a side plan view showing the operation of the retaining device for the wood sawing machine according to the preferred embodiment of the present invention.
Figure 13:
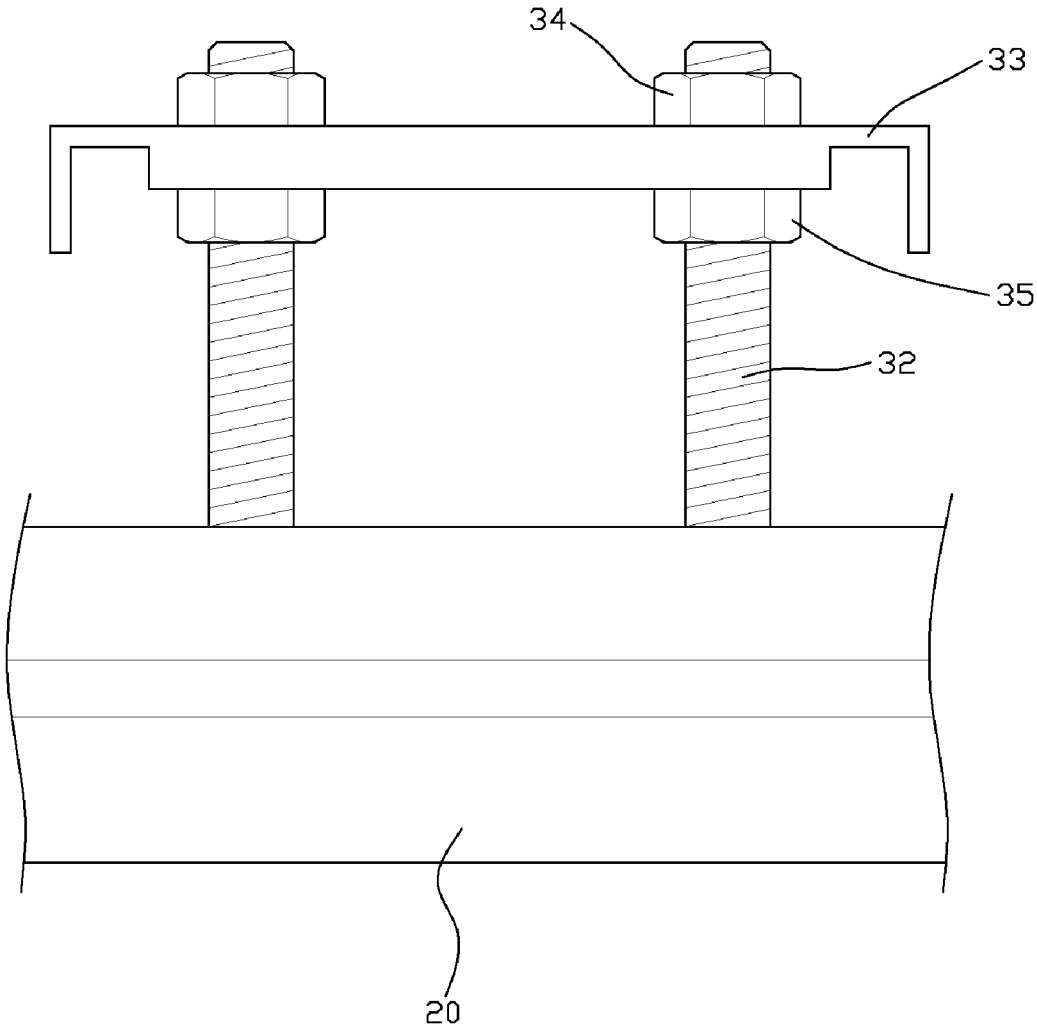
FIG. 13 is a cross sectional view showing the operation of the retaining device for the wood sawing machine according to the preferred embodiment of the present invention.
Figure 14:
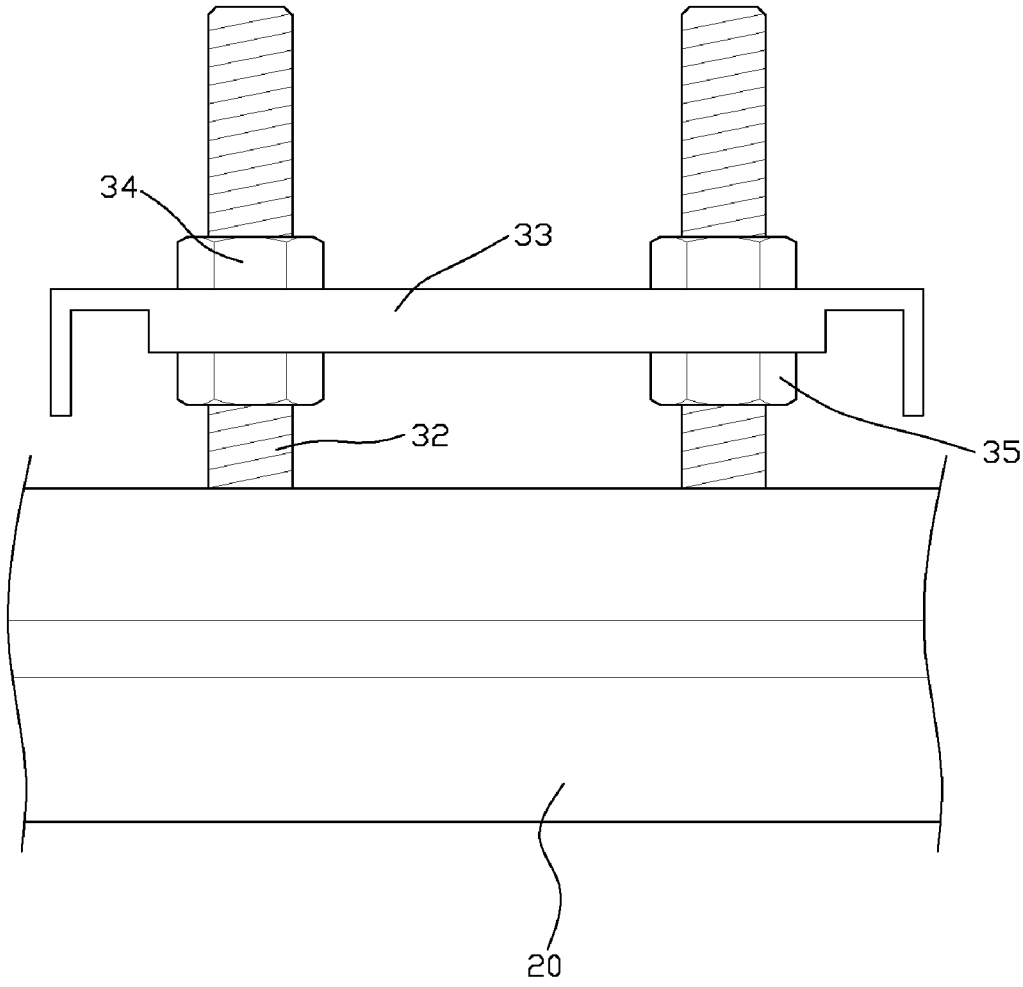
FIG. 14 is another cross sectional view showing the operation of the retaining device for the wood sawing machine according to the preferred embodiment of the present invention.

Furthermore, during adjusting the vertically moving set 30, the first adjusting nuts 34 and the second adjusting nuts 35 are opposite to the screw rods 32 to change heights of the longitudinally displacing holder 33 and the vertically moving set 30 (as illustrated in FIG. 12), when the first adjusting nuts 34 and the second adjusting nuts 35 are moved upward, the longitudinally displacing holder 33 is adjusted toward a higher position (as shown in FIG. 13), and when the first adjusting nuts 34 and the second adjusting nuts 35 are moved downward, the longitudinally displacing holder 33 is adjusted toward a lower position. Therefore, the first adjusting nuts 34 and the second adjusting nuts 35 are used to adjust the longitudinally displacing holder 33 and the retaining and pressing assembly 40 finely.

While we have shown and described various embodiments in accordance with the present invention, it is clear to those skilled in the art that further embodiments may be made without departing from the scope of the present invention.

What is claimed is:

1. A retaining device for a wood sawing machine comprising:

an index table fixed on a cutting deck of the wood sawing machine to displace straightly and reciprocately along the cutting deck;

a guiding plate fixed on the cutting deck and connected with the index table, and including a slot disposed thereon;

a vertically moving set including at least one sliding block, at least one screw rod, a longitudinally displacing holder, at least one first adjusting nut, and at least one second adjusting nut; wherein the at least one sliding block is slidably connected with the slot of the guiding plate and displaces along the slot reciprocately, the at least one screw rod is coupled on the sliding block and the longitudinally displacing holder includes holes arranged on top and bottom ends thereof individually to insert the at least one screw rod, the at least one second adjusting nut is screwed on the at least one screw rod and located beneath the longitudinally displacing holder, the at least one first adjusting nut is screwed on the at least one screw rod and located above the longitudinally displacing holder;

a retaining and pressing assembly including a handle, two arms, two connecting posts, two stems, and a pressing panel, wherein one end of the arm is locked on one end of the handle, and each arm includes an orifice, one end of the connecting post is axially connected to a first bore of the longitudinally displacing holder and the other end of the connecting post is connected to the orifice of the arm, one end of the stem is coupled to the pressing panel, and another end of the stem is axially connected to another end of the arm, between the two ends of the stem are defined a first aperture and a second aperture to couple the stem alternatively to a second bore of the longitudinally displacing holder, and the two stems are axially connected to the second bores of the longitudinally displacing holder by a coupling shank.

2. The retaining device for the wood sawing machine as claimed in claim 1, wherein the index table includes an abutting surface and displaces along a rail of the cutting deck, and the index table allows to rotate at a fixed position so that an angle between the abutting surface and a saw blade is adjusted.

3. The retaining device for the wood sawing machine as claimed in claim 1, wherein the guiding plate includes a first side plane, a second side plane opposite to the first side plane, a bottom plane connected with the first and the second side plane, and a top plane opposite to the bottom plane; the first side plane is biased against the index table by using a plurality of locking elements so that the bottom plane contacts with the cutting deck, and a workpiece is in contact with the second side plane, the top plane includes the slot disposed thereon.

4. The retaining device for the wood sawing machine as claimed in claim 1, wherein the retaining and pressing assembly includes two press members, each press member is coupled between the stem and the pressing panel.

5. The retaining device for the wood sawing machine as claimed in claim 1, wherein the retaining and pressing assembly includes a coupling shank, the first aperture or the second aperture of the stem is axially coupled on the second bore of the longitudinally displacing holder by the coupling shank.

* * * * *